US005752533A

United States Patent [19]

Edwards

[11] Patent Number: 5,752,533

[45] Date of Patent: May 19, 1998

[54] JET SPRAY NOZZLE WITH THIRD LEVEL WASH ARM

[75] Inventor: James M. Edwards, Kinston, N.C.

[73] Assignee: White Consolidated Industries, Inc., Cleveland, Ohio

[21] Appl. No.: 661,939

[22] Filed: Jun. 11, 1996

[51] Int. Cl.[6] ..... B08B 3/02

[52] U.S. Cl. ..... 134/176; 134/179; 134/198; 239/251

[58] Field of Search ..... 134/172, 176, 134/179, 198; 239/251

[56] References Cited

U.S. PATENT DOCUMENTS

| | | |
|---|---|---|
| 3,064,665 | 11/1962 | Martiniak . |
| 3,370,869 | 2/1968 | Dutcher . |
| 3,672,573 | 6/1972 | Morgan . |
| 3,776,465 | 12/1973 | Baker . |
| 3,866,837 | 2/1975 | Jenkins . |
| 3,951,684 | 4/1976 | LaPrad et al. . |
| 3,989,054 | 11/1976 | Mercer . |
| 4,134,414 | 1/1979 | Jarvis et al. . |
| 4,172,463 | 10/1979 | Woolley et al. . |
| 4,174,723 | 11/1979 | Long . |
| 4,418,868 | 12/1983 | Gurubatham et al. . |
| 5,211,190 | 5/1993 | Johnson et al. . |
| 5,235,994 | 8/1993 | Comin et al. . |
| 5,241,975 | 9/1993 | Yanagihara . |
| 5,330,102 | 7/1994 | Jarvis et al. . |
| 5,427,129 | 6/1995 | Young, Jr. et al. . |
| 5,433,228 | 7/1995 | Dingler . |

*Primary Examiner*—Frankie L. Stinson
*Attorney, Agent, or Firm*—Pearne, Gordon, McCoy and Granger

[57] ABSTRACT

A dishwasher includes a tub, lower and upper racks removably mounted within the tub, a first-level spray arm mounted in the tub above below the lower rack, a second-level spray arm mounted in the tub between the lower and upper racks and having an upwardly extending funnel, and a nozzle assembly mounted at the top of the tub above the upper rack. The nozzle assembly includes a downwardly directed spray nozzle axially aligned with the funnel, a third-level spray arm which encircles and rotates about the nozzle, and a retainer which is secured to the nozzle below the third-level spray arm and supports the third-level spray arm. The nozzle has a main body forming a central passage and a mounting flange integral with an upper end of the main body and forming transfer openings about the central passage. The nozzle extends through the third-level spray arm so that wash fluid is sprayed through the central opening to the funnel of the second-level spray arm and wash fluid is supplied through the transfer openings to an internal cavity of the third-level spray arm.

13 Claims, 3 Drawing Sheets

JET SPRAY NOZZLE WITH THIRD LEVEL WASH ARM

BACKGROUND OF THE INVENTION

1. Field of the Invention

The present invention generally relates to a dishwasher of the household type and, more particularly, to a dishwasher water distribution system having first, second, and third level spray arms.

2. Description of Related Art

Nearly all dishwasher units made today include a lower spray arm that rotates about a vertical axis. Most larger dishes are carried an a lower rack which rolls on ledges formed on the sides of a wash tub and out onto a folded down front door. An upper rack is also provided for smaller dishes, cups, and glasses and is mounted on rollers and channels near the top of the wash tub interior. The upper rack is also movable into and out of the wash tub for loading and unloading.

It has been found that a sole first-level spray mechanism located below the lower rack does not always give good washability performance because the spray can be blocked by the articles on the lower rack and very little water may reach some articles on the upper rack or the top of the articles on the lower rack. Therefore, nearly all dishwashers include a second-level spray mechanism between the racks to provide an upward spray directly onto articles in the upper rack and a downward spray directly onto the top of the articles on the lower rack. However, washability performance may still be affected by the fact that very little water, if any, may reach the top of the articles on the upper rack. Therefore, some dishwashers include a third-level spray mechanism above the upper rack to provide a downward spray directly onto the top of the articles in the upper rack. Prior art water distribution systems having spray mechanisms at three different levels, however, are relatively complex, have a relatively large number of components, and require a relatively large amount of water power. Accordingly, there is a need in the art for a three-level water distribution system that is relatively simple and inexpensive to produce, has a relatively few number of parts, and operates with a relatively low amount of water power.

SUMMARY OF THE INVENTION

The present invention provides a dishwasher including a tub having a bottom surface and a top surface, a lower rack removably mounted in the tub above the bottom surface, and an upper rack removably mounted in the tub above the lower rack. The dishwasher also includes a first-level spray arm mounted in the tub below the lower rack for rotation about a vertical axis, a second-level spray arm mounted in the tub above the lower rack and below the upper rack for rotation about a vertical axis, and a nozzle assembly mounted in the tub above the upper rack. The second-level spray arm has an upwardly extending funnel for receiving a downward jet spray of wash fluid from the nozzle assembly. The nozzle assembly includes a downwardly directed nozzle in substantial axial- alignment with the funnel to provide the downward jet spray to the funnel and a third-level spray arm mounted for rotation about a vertical axis.

According to a preferred embodiment, the third-level spray arm encircles and rotates about the nozzle and is supported by a retainer secured to the nozzle below the third-level spray arm. The nozzle has a main body forming a central passage and a flange integral with an upper end of the main body and forming transfer openings about the central passage. The nozzle extends through the third-level spray arm with the central passage aligned with the funnel and the transfer openings in fluid communication with an internal cavity of the third-level spray arm.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
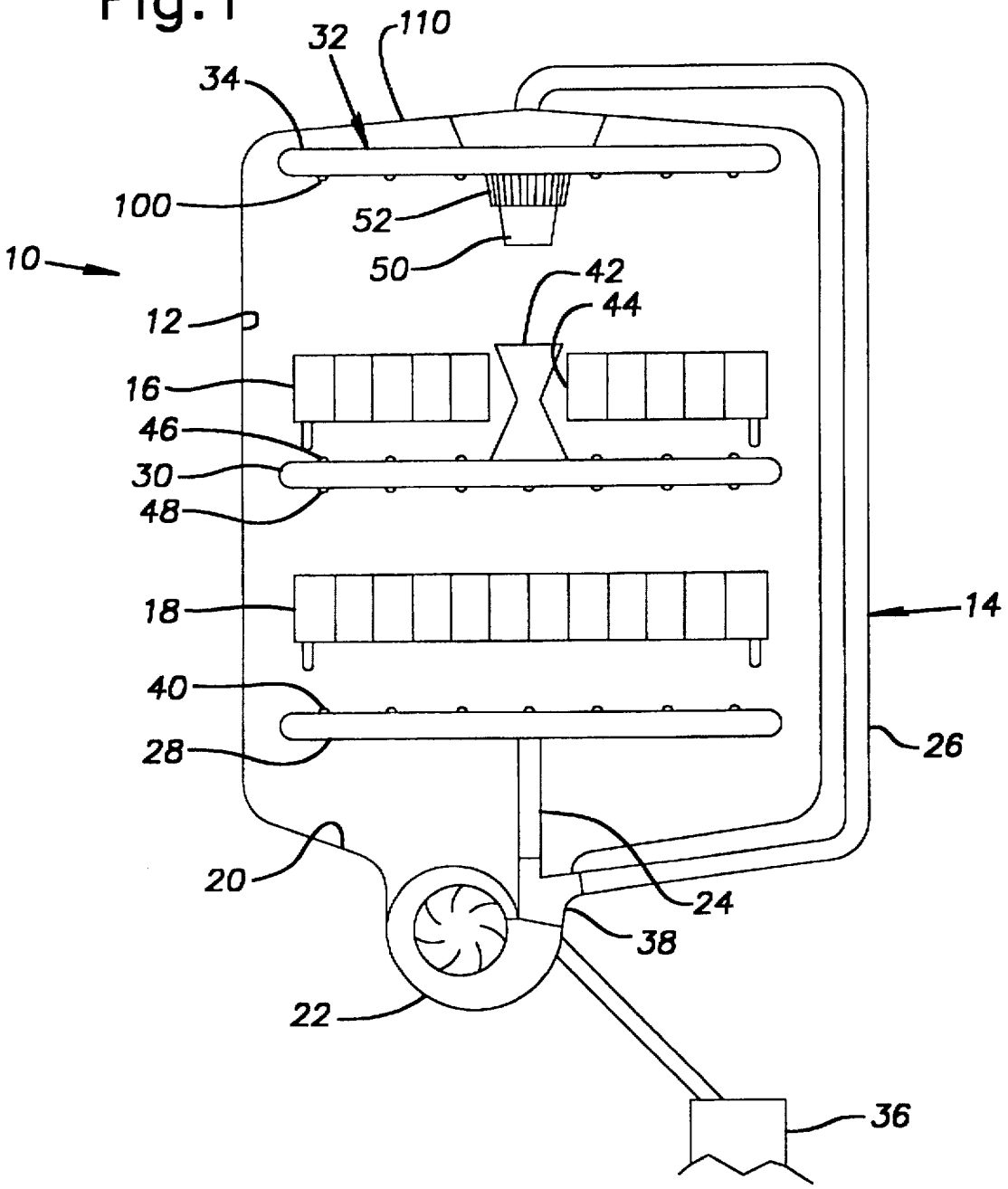
FIG. 1 is a diagrammatic view of a dishwasher embodying the present invention.

FIG. 1 schematically illustrates a dishwasher 10 according to the present invention. The dishwasher 10 generally includes a wash tub 12, a water distribution system 14, and upper and lower baskets or racks 16, 18. The tub 12 typically is located within a cabinet (not shown) and has an open front side closed by a downwardly pivoting door (not shown). A bottom wall of the tub 12 forms a reservoir or sump 20 for collecting wash fluid therein.

The racks 16, 18 are located within the wash tub 12 for supporting objects to be washed such as, for example, dishes, silverware, glasses, and cookware. The racks 16, 18 are typically formed of metal wire bent to shape and covered with a rubber or plastic material to prevent rust and to protect the objects to be washed. The racks 16, 18 are removable from the tub 12 for loading and unloading the objects to be washed. The lower rack 18 typically has wheels which roll along rails, at the side walls of the tub 12, which align with the inner surface of the door when the door is in an open position so that the lower rack 18 can roll onto the door. The upper rack 16 typically is mounted on movable rails carried on side walls of the tub 12 and is movable into and out of the tub 12 above the lower rack 18.

The water distribution system 14 includes a circulation pump 22, a first or lower level fluid delivery tube 24, a second or upper fluid delivery tube 26, a first or lower level spray arm 28, a second or intermediate level spray arm 30, and a nozzle assembly 32 having a third or upper level spray arm 34. The pump 22 is centrally located at the bottom wall of the tub 12 with an inlet of the pump connected to the sump 20. The pump 22 operates in a wash mode to pump wash fluid from the sump 20 to the wash arms 28, 30, 34 and in a drain mode to pump the wash fluid from the sump 20 to a household drain 36. A first outlet of the pump 22 is connected to a valve 38 which distributes the wash fluid to the spray arms 28, 30, 34 through the lower and upper fluid delivery tubes 24, 26. The valve 38 can either alternately or simultaneously deliver the wash fluid to the upper and lower fluid delivery tubes 24, 26. A second outlet of the pump 22 is connected to a drain pipe 40 which delivers the wash fluid to the household drain 36.

The first-level spray arm 28 is rotatably supported below the lower rack 18 and is supplied with wash fluid through the lower fluid delivery tube 24 which is relatively straight and short in length. The lower fluid delivery tube 24 has an inlet end in fluid communication with the valve 38 and an outlet end in fluid communication with a hollow interior of the first-level spray arm 28 through a central opening in the bottom of the first-level spray arm 28. The first-level spray arm 28 has a plurality of upwardly directed openings 40 along its top surface. Wash fluid delivered to the hollow interior of the first-level spray arm 28 projects through the openings 40 in a series of upwardly-directed sprays of wash fluid. These upwardly-directed sprays impinge upon the objects in the lower rack 18 to loosen food particles or other material adhering thereto.

The second-level spray arm 30 is rotatably supported below the upper rack 16 by a collecting conduit or funnel 42. The funnel 42 is mounted to the upper rack 16 within a central opening 44 in the upper rack 16. The second-level spray arm 30 is supplied with wash fluid through the upper fluid delivery tube 26 which is generally c-shaped and relatively long in length. The upper fluid delivery tube 26 has an inlet end in fluid communication with the valve 38 and an outlet end in fluid communication with the nozzle assembly 32 which is centrally located within the wash tub 12 at a top wall of the wash tub 12. The upper fluid delivery tube 26 extends outside the wash tub 12 and to the top wall of the tub 12 at the nozzle assembly 32.

The nozzle assembly 32 provides a downwardly directed jet of wash fluid to the funnel 42. When the upper rack 16 is fully positioned within the wash tub 12, the funnel 42 is axially aligned with and vertically spaced below the nozzle assembly 32. The funnel 42 collects the jet of wash fluid and feeds or delivers the wash fluid to a hollow interior of the second-level spray arm 30 through a central opening in the top of the second-level spray arm 30. The second-level spray arm 30 has a plurality of upwardly directed openings 46 along its top surface. Wash fluid delivered to the hollow interior of the second-level spray arm 30 projects through the openings 46 in a series of upwardly-directed sprays of wash fluid. These upwardly-directed sprays impinge upon the objects in the upper rack 16 to loosen food p articles or other material adhering thereto. The second-level spray arm 30 is advantageously provided with downwardly directed openings 48 to project downwardly-directed sprays of wash water which impinge on objects in the lower rack 18.

Figure 2:
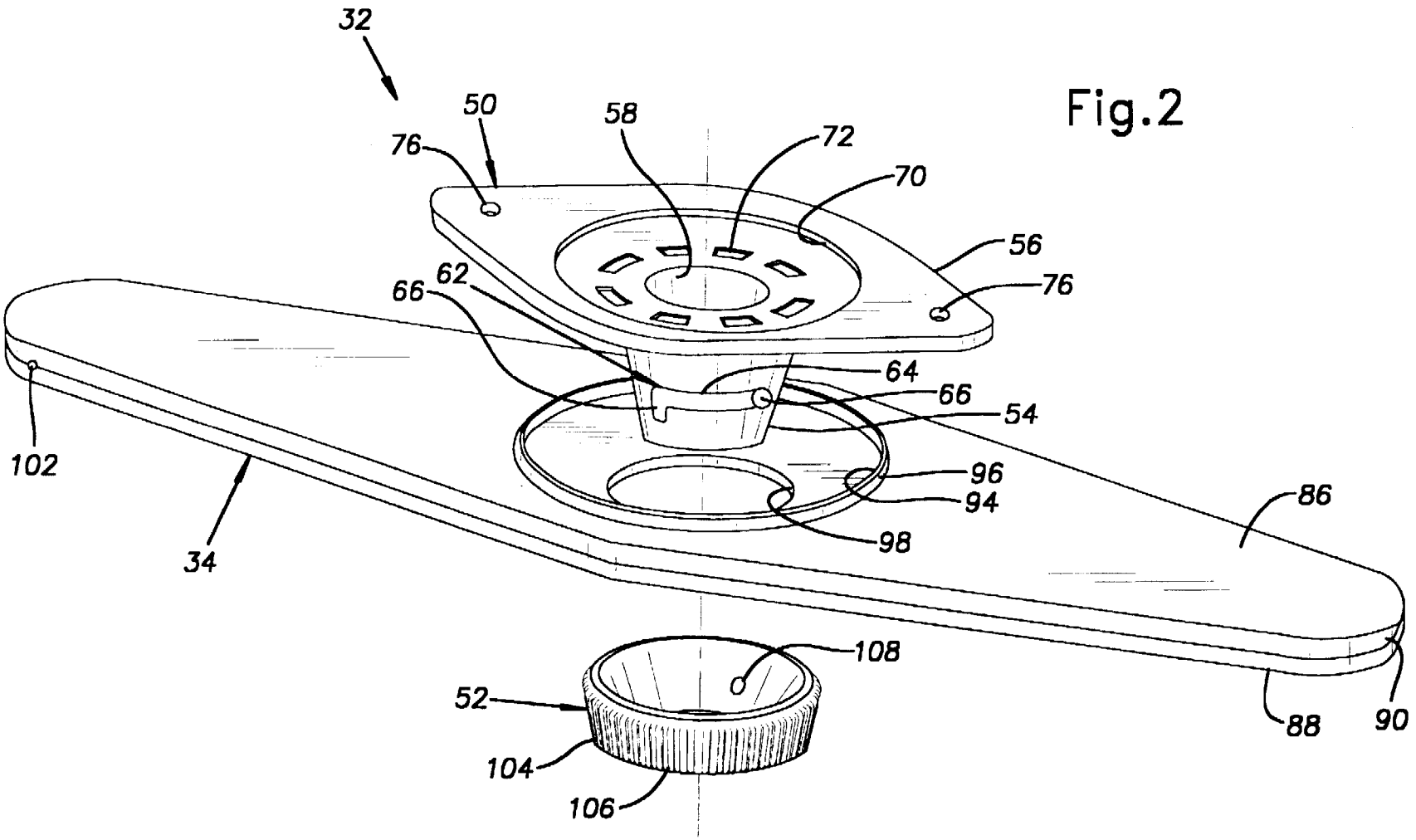
FIG. 2. is an exploded perspective view of a nozzle assembly of the dishwasher of FIG. 1.
Figure 3:
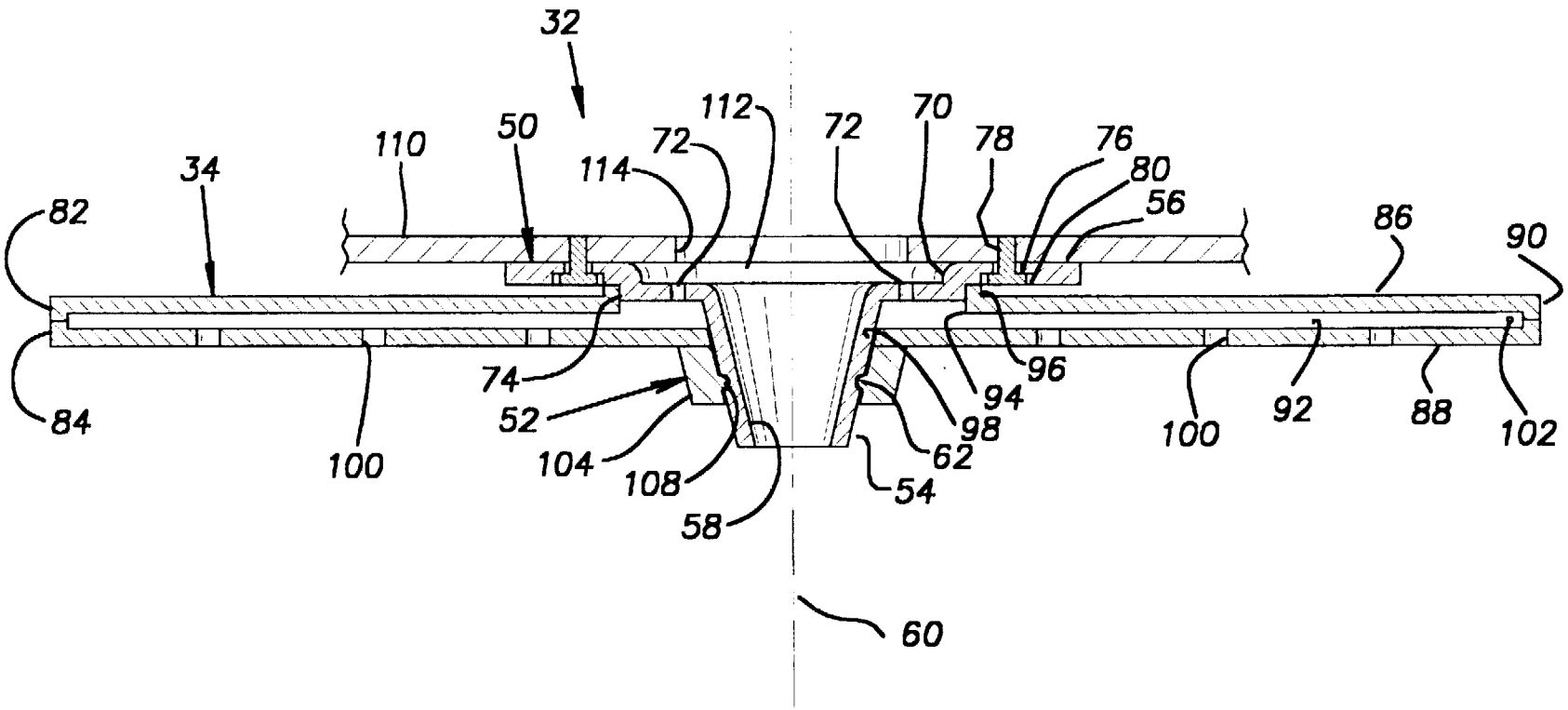
FIG. 3 is an elevational view, in cross-section, of the nozzle assembly of the dishwasher of FIG. 1.

As best shown in FIGS. 2 and 3, the nozzle assembly 32 includes the third-level spray arm 34, a nozzle 50, and retainer 52 which retains the third-level spray arm 34 on the nozzle 50. The nozzle 50 has a main body 54 and a mounting flange 56 integral therewith. The main body 54 is formed by a generally annular shaped wall having generally frusto-conically shaped inner and outer surfaces. The inner surface forms a spray jet nozzle or central passage 58 having a substantially vertical axis 60. The central passage 58 has a decreasing cross-sectional area in a downward direction so that the size of the lower end or outlet of the central passage 58 is smaller than the size of the upper end or inlet of the central passage 58.

The outer surface of the main body 54 is provided with at least two grooves 62 equally spaced about the periphery of the main body 54. Each groove 54 has a circumferentially extending main portion 64, an axially and downwardly extending entrance portion 66 at a first end of the main portion 64, and a locking portion 68 at a second end of the main portion 64. Preferably, the depth of the main portion 64 of the groove 62 gradually decreases in a direction from the first end to the second end. The bottom surface of the entrance portion 66 is at a substantially constant distance from the axis 60 of the nozzle 50 such that the depth of the entrance portion 66 gradually increases in an upward direction due to the shape of the outer surface of the main body 54. The locking portion 68 has a depth generally greater than the depth of the second end of the main portion 64, which is adjacent the locking portion 68, and generally equal to the depth of the first end of the main portion 64.

The mounting flange 56 is generally planar and integral with the upper or inlet end of the nozzle main body 54. An upper side of the mounting flange 56 forms a central, circularly-shaped, recess 70 which opens into the inlet of the main body central passage 58. A plurality of circumferentially spaced-apart transfer openings 72 are formed within the recess 70 and encircle the inlet of the central passage 58. The transfer openings 72 extend through the mounting flange 56 from the upper side to the lower side. While the illustrated embodiment has eight generally rectangularly-shaped transfer openings 72, it is noted that a greater or lesser number of transfer openings and/or transfer openings having other shapes can be utilized.

The lower side of the mounting flange 58 has a step forming a radially outward facing shoulder 74. Near the outer ends of the mounting flange 58 are openings 76 sized for fastening members 78 such as, for example a screw or a bolt. The openings 76 are located radially outward of both the recess 76 at the upper side of the mounting flange 56 and the shoulder 74 at the lower side of the mounting flange 56. Preferably the openings 76 are provided with counterbores 80 at the lower side of the mounting flange 56 to reduce or eliminate the degree to which the fastening members 78 extend below the lower surface of the mounting flange 56.

The third-level spray arm 34 preferably includes upper and lower portions 82, 84 molded from a plastic material and joined by conventional means. The spray arm 34 has a top wall 86, a bottom wall 88, and a side wall 90 which joins the outer peripheries of the top and bottom walls 86, 88. The walls 86, 88, 90 form a pair of outwardly extending arms with a substantially hollow interior cavity 92. The top wall 86 forms a central upper opening 94 sized for closely receiving the shoulder 74 of the nozzle 50. Preferably, a upwardly directed lip 96 encircles the upper opening 94 to space the top wall 86 of the spray arm 34 away from the lower surface of the nozzle mounting flange 56.

The bottom wall 88 forms a central lower opening 98 sized such that the main body 54 of the nozzle 50 closely passes therethrough. The edge of the bottom wall 88 forming the lower opening 98 is angled to closely match the outer surface of the nozzle main body 54. The bottom wall 88 also forms a plurality of downwardly directed spray openings 100 arranged to provide a balanced upward reaction force on the arms and spray downward to cover the upper rack 16 as the third-level spray arm 34 rotates.

The spray arm 34 is also provided with drive openings 102 to provide a driving force to rotate the spray arm 34. The side wall 90 forms the drive openings 102 on opposite sides of the arms and near outer ends of the arms. Alternatively, the drive openings 102 could be located on the bottom wall 88 of the arms or at least some of the spray openings 100 could be angularly directed to provide the driving force to rotate the spray arm 34.

The retainer 52 has a generally annular wall 104 forming frusto-conically shaped inner and outer surfaces. The inner surface is sized to closely receive the main body 54 of the nozzle 50 therein. The outer surface preferably is provided with a plurality of circumferentially-spaced and axially extending grooves 106 so that the outer surface is easily gripped for installation and removal of the retainer 52. The retainer 52 also includes at least two radially inwardly extending protrusions 108 which are equally spaced about the periphery of the inner surface. The protrusions 108 are sized and located to cooperate with the grooves 62 of the nozzle 50 to attach the retainer 52 to the nozzle 50. It is noted that, while the illustrated embodiment has two protrusions 108 and cooperating grooves 62, having three protrusions 108 and cooperating grooves 62 prevents the retainer 52 from pivoting about a lateral axis extending through the two protrusions 108.

As best shown in FIG. 3, the nozzle assembly 32 is installed to the top wall 110 of the wash tub 12 by the fastening members 78 extending through the openings 76 of the mounting flange 56. The recess 70 in the upper surface of the nozzle mounting flange 56 cooperates with the lower surface of the tub top wall 10 to form a chamber 112. The chamber 112 is in fluid communication with the upper fluid delivery tube 26 through an opening 114 provided in the top wall 110 of the tub 12. The spray arm 34 is positioned over the nozzle 50 with the shoulder 74 of the nozzle 50 received in the upper opening 94 of the spray arm 34 and the main body 54 of the nozzle 50 received in the lower opening 98 of the spray arm 34.

The spray arm 34 is held in place as the retainer 52 is positioned over the lower end of the nozzle main body 54 with the protrusions 108 oriented to align with the entrance portions 66 of the nozzle grooves 62. The retainer 52 is raised so that the protrusions 108 travel upwardly within the entrance portions 66 of the grooves 62 until the protrusions 108 engage the tops of the entrance portions 66. The retainer 52 is then rotated so that the protrusions 108 travel across the main portions 64 of the nozzle grooves 62 until the protrusions 108 snap into the locking portions 68 of the nozzle grooves 62. An increasing force is required to rotate the retainer 52 as the depths of the main portions 64 of the grooves 62 decrease. Once in the retainer 52 is in place, axial movement of the retainer 52 is prevented by the protrusions 108 within the grooves 62 so that the retainer 52 holds the spray arm 34 in position on the nozzle 50. Reverse rotation of the retainer 52 is resisted by the relatively large force required to move the protrusions 108 from the locking portions 68 to the substantially shallower main portions 64. It is noted that other means for retaining the spray arm 34 on the nozzle 50 could be utilized such as, for example, a threaded nut.

As best shown in FIGS. 1 and 3, the third-level spray arm 34 is rotatably supported at the top wall 110 of the wash tub 12 above the upper rack 16 and is supplied with wash fluid through the upper fluid delivery tube 26. The outlet of upper fluid delivery tube 26 is in fluid communication the nozzle assembly 32. The wash fluid is delivered into the chamber 112 formed between the nozzle 50 and the top wall 110 of the tub 12. The wash fluid passes from the chamber 112 through the central opening 58 of the nozzle 50 to provide a downward jet of wash fluid from the nozzle 50 to the funnel 42 of the second-level spray arm 30.

The wash fluid also passes from the chamber 112 through the transfer openings 72 into the interior cavity 92 of the third-level spray arm 34. A portion of the wash fluid in the interior cavity 92 projects through the drive openings to rotate the third-level spray arm 34 about the nozzle 50. The third-level spray arm 34 rotates on the central axis 60 of the nozzle 50. It is noted that the each of the spray arms 28, 30, 34 rotate on substantially coaxial vertical axes which are centrally located in the wash tub 12. Another portion of the wash fluid in the interior cavity 92 projects through the spray openings 100 in the bottom of the third-level spray arm 34 in a series of downwardly-directed sprays of wash fluid. These downwardly-directed sprays impinge upon the objects in the upper rack 16 to loosen food particles or other material adhering thereto. The nozzle 50 and the third-level spray arm 34 are sized to cooperate with each other so that both the third-level spray arm 34 is rotatable about the nozzle 50 and a relatively close seal is provided therebetween to minimize leaking wash fluid which would not be available for spraying.

Although particular embodiments of the invention have been described in detail, it will be understood that the invention is not limited correspondingly in scope, but includes all changes and modifications coming within the spirit and terms of the claims appended hereto.

What is claimed is:

1. A dishwasher comprising:

a tub having a bottom surface and a top surface;

a lower rack removably mounted in said tub above said bottom surface;

an upper rack removably mounted in said tub above said lower rack;

a first-level spray arm mounted in said tub below said lower rack for rotation about a vertical axis;

a second-level spray arm mounted in said tub above said lower rack and below said upper rack for rotation about a vertical axis, said second-level spray arm having an upwardly extending funnel; and a nozzle assembly mounted in said tub above said upper rack, said nozzle assembly including a downwardly directed nozzle substantially axially aligned with said funnel and having a frustro-conically shaped outer surface, a third-level spray arm mounted for rotation about a vertical axis, and a retainer secured to said nozzle below said third-level spray arm and supporting said third-level spray arm, said nozzle extending through said third-level spray arm, said retainer having a generally annularly-shaped wall with a frustro-conically shaped inner surface sized to cooperate with said outer surface of said nozzle and at least two protrusions inwardly extending from said inner surface, wherein said nozzle has at least two grooves adapted to cooperate with said protrusions such that said retainer is securable to and removable from said nozzle upon rotation of said retainer relative to said nozzle.

2. The dishwasher according to claim 1, wherein said grooves each have a circumferentially extending main portion an axially extending entrance portion at a first end of said main portion, and a locking portion at a second end of said main portion.

3. The dishwasher according to claim 2, wherein said main portion has a decreasing depth from said first end to said second end, and said locking portion has a depth greater than said main portion adjacent said locking portion.

4. A dishwasher comprising:

a tub having a bottom surface and a top surface;

a lower rack removably mounted in said tub above said bottom surface;

an upper rack removably mounted in said tub above said lower rack;

a first-level spray arm mounted in said tub below said lower rack for rotation about a vertical axis;

a second-level spray arm mounted in said tub above said lower rack and below said upper rack for rotation about a vertical axis, said second-level spray arm having an upwardly extending funnel; and a nozzle assembly mounted in said tub above said upper rack, said nozzle assembly including a downwardly directed nozzle substantially axially aligned with said funnel and a third-level spray arm mounted for rotation about a vertical axis and having an internal cavity, said nozzle having a main body and a flange integral with an upper end of said main body, said main body having a central passage with a vertical axis and said flange having transfer openings about said central passage, wherein said nozzle extends through said third-level spray arm with said transfer openings in fluid communication with said internal cavity of said third-level spray arm.

5. The dishwasher according to claim 4, wherein said flange has an upper surface forming a recess, and said central passage of said main body and said transfer openings open into said recess.

6. The dishwasher according to claim 4, wherein said flange has a lower surface forming a radially outward facing shoulder encircling said main body and said third-level spray arm has a central upper opening receiving said shoulder therein.

7. The dishwasher according to claim 6, wherein said third-level spray arm has an upwardly extending lip encircling said central upper opening and spacing said third-level spray arm from said flange.

8. The dishwasher according to claim 4, wherein said nozzle assembly further includes a retainer secured to said nozzle below said third-level spray arm and supporting said third-level spray arm.

9. A dishwasher comprising:

a tub having a bottom surface and a top surface;

a lower rack removably mounted in said tub above said bottom surface;

an upper rack removably mounted in said tub above said lower rack and below said top surface;

a rotatable first-level spray arm mounted in said tub below said lower rack;

a rotatable second-level spray arm mounted in said tub above said lower rack and below said upper rack, said second-level spray arm having an upwardly extending funnel; and a nozzle assembly mounted in said tub above said upper rack, said nozzle assembly including a downwardly directed nozzle substantially axially aligned with said funnel, a third-level spray arm encircling and rotatable about said nozzle, and a retainer secured to said nozzle below said third-level spray arm and supporting said third-level spray arm, said nozzle having a main body and a flange integral with an upper end of said main body, said main body having a central passage with a vertical axis and said flange having transfer openings about said central passage, said nozzle extending through said third-level spray arm with said transfer openings in fluid communication with an internal cavity of said third-level spray arm.

10. A nozzle assembly for a dishwasher comprising:

a nozzle for directing a downward jet of wash water and having a frusto-conically shaped outer surface;

a spray arm encircling and rotatable about said nozzle; and a retainer secured to said nozzle below said third-level spray arm and supporting said third-level spray arm, said retainer having a generally annularly-shaped wall with a frustro-conically shaped inner surface sized to cooperate with said outer surface of said nozzle and at least two protrusions inwardly extending from said inner surface, wherein said nozzle has at least two grooves adapted to cooperate with said protrusions such that said retainer is securable to and removable from said nozzle upon rotation of said retainer relative to said nozzle.

11. The dishwasher according to claim 10, wherein said grooves each have a circumferentially extending main portion an axially extending entrance portion at a first end of said main portion, and a locking portion at a second end of said main portion.

12. A nozzle assembly for a dishwasher comprising:

a nozzle for directing a downward jet of wash water and having a main body and a flange integral with an upper end of said main body, said main body having a central passage and said flange having transfer openings about said central passage;

a spray arm encircling and rotatable about said nozzle and having an internal cavity; and a retainer attached to said nozzle below said third-level spray arm and securing said third-level spray arm to said nozzle, wherein said nozzle extends through said spray arm with said transfer openings in fluid communication with said internal cavity of said spray arm.

13. The dishwasher according to claim 12, wherein said retainer is removably secured to said nozzle.

* * * * *

UNITED STATES PATENT AND TRADEMARK OFFICE

CERTIFICATE OF CORRECTION

PATENT NO. : 5,752,533

DATED : May 19, 1998

INVENTOR(S) : James M. Edwards

It is certified that error appears in the above-indentified patent and that said Letters Patent is hereby corrected as shown below:

On the face of the patent, section [56] References Cited, add the following references:

--U.S. PATENT DOCUMENTS

| | | | |
|---|---|---|---|
| 2,663,902 | 1/1954 | Campion | 134/176 |
| 3,077,200 | 2/1963 | Guth | 134/176 |
| 3,538,927 | 11/1970 | Wallgren | 134/180 |
| 3,809,106 | 5/1974 | Crabtree | 134/176 |
| 3,989,054 | 11/1976 | Mercer | 134/176 |
| 5,546,968 | 8/1996 | Joen et al | 134/179 |

FOREIGN PATENT DOCUMENTS

| | | | |
|---|---|---|---|
| 2409740 | 7/1979 | FRANCE | 134/176 |
| 1183214 | 12/1964 | GERMANY | 134/176 |
| 1628600 | 8/1970 | GERMANY | 134/176 |
| 1628601 | 8/1970 | GERMANY | 134/176--. |

Signed and Sealed this

Twenty-second Day of September, 1998

*Attest:*

Bruce Lehman

BRUCE LEHMAN

*Attesting Officer*

*Commissioner of Patents and Trademarks*